US006944961B2

(12) United States Patent
Carroll

(10) Patent No.: US 6,944,961 B2
(45) Date of Patent: Sep. 20, 2005

(54) MULTI-FUNCTION FINGER GUIDE

(76) Inventor: Timothy B. Carroll, P.O. Box 14929, Tallahassee, FL (US) 32310

( * ) Notice: Subject to any disclaimer, the term of this patent is extended or adjusted under 35 U.S.C. 154(b) by 0 days.

(21) Appl. No.: 10/650,097

(22) Filed: Aug. 26, 2003

(65) Prior Publication Data

US 2005/0044734 A1 Mar. 3, 2005

(51) Int. Cl.[7] ..... B42L 13/02
(52) U.S. Cl. ..... 33/42
(58) Field of Search ..... 33/42, 755, 759, 33/770

(56) References Cited

U.S. PATENT DOCUMENTS

| | | | | |
|---|---|---|---|---|
| 429,087 | A | 5/1890 | Dickins | |
| 523,380 | A | 7/1894 | Snell | |
| 790,923 | A * | 5/1905 | Rohrs | 33/42 |
| 1,448,827 | A * | 3/1923 | Burnett | 33/42 |
| 1,732,906 | A * | 10/1929 | Morton | 33/42 |
| 2,603,873 | A * | 7/1952 | Shaw | 33/42 |
| 3,192,630 | A | 7/1965 | Dineson | |
| 4,976,037 | A | 12/1990 | Hines | |
| 5,189,801 | A | 3/1993 | Nicely | |
| 5,349,760 | A | 9/1994 | DeVito | |
| 5,647,063 | A | 7/1997 | Bates | |
| 5,782,007 | A | 7/1998 | Harris | |
| 5,842,284 | A | 12/1998 | Goldman | |
| 6,012,165 | A | 1/2000 | Cain | |
| 6,038,697 | A | 3/2000 | Kasarnich | |
| 2002/0032969 | A1 | 3/2002 | Cardew | |
| 2002/0100174 | A1 | 8/2002 | Gooden | |

FOREIGN PATENT DOCUMENTS

| | | |
|---|---|---|
| GB | 2203839 A | 10/1988 |
| JP | 2002173812 | 6/2002 |

* cited by examiner

*Primary Examiner*—Christopher W. Fulton
(74) *Attorney, Agent, or Firm*—J. Wiley Harton

(57) ABSTRACT

A finger guide for use in measuring, marking, scribing, cutting and similar operations common to the field of construction. The device assists in performing these operations on an object such as a board or piece of drywall. The finger guide has a top guide which is laid on the top surface of an object, and a perpendicular edge guide which abuts an edge of the object. The edge guide includes an index finger hole which allows the user to slip the device on his or her index finger and "wear" it like a ring. The top guide opens into a tape trough positioned to receive and hold a length of metal tape from a conventional tape measure. The top guide also includes reference marks used for measuring. Other features allow the device to be used as a saw guide in conjunction with a conventional circular saw.

4 Claims, 10 Drawing Sheets

MULTI-FUNCTION FINGER GUIDE

BACKGROUND OF THE INVENTION

1. Field of the Invention

This invention relates to the field of hand tools. More specifically, the invention comprises a finger guide which assists a user in measuring, cutting, marking, and scoring objects such as lumber, plywood, and sheetrock.

2. Description of the Related Art

Numerous marking and cutting guides are used in the construction industry. Tape measures are employed to measure distances. Framing squares provide perpendicular markings for transverse cuts. Large saw guides are used for cutting straight lines over large distances (such as "rip" cuts along the length of a board). These devices tend to be fairly large, making them difficult to carry around the work site.

Additionally, many of the prior art devices require the user to run his or her fingers along the edge of the object to be cut. This operation is not difficult, but when it is repeated many times throughout a work day it produces skin abrasions. Splinters and reinforcing fibers may also be lodged in the user's hand.

BRIEF SUMMARY OF THE INVENTION

The present invention comprises a finger guide for use in measuring, marking, scribing, cutting and similar operations common to the field of construction. The device assists in performing these operations on an object such as a board or piece of drywall. The finger guide has a top guide which is laid on the top surface of an object, and a perpendicular edge guide which abuts an edge of the object. The edge guide includes an index finger hole which allows the user to slip the device on his or her index finger and "wear" it like a ring. The top guide opens into a tape trough positioned to receive and hold a length of metal tape from a conventional tape measure. The top guide also includes reference marks used for measuring. Other features allow the device to be used as a saw guide in conjunction with a conventional circular saw.

REFERENCE NUMBERS IN THE DRAWINGS

| | |
|---|---|
| 10 | finger guide |
| 12 | top guide |
| 14 | edge guide |
| 16 | tape trough |
| 18 | reference mark |
| 20 | index finger hole |
| 21 | middle finger trough |
| 22 | top mating surface |
| 24 | edge mating surface |
| 26 | relief bevel |
| 28 | fillet |
| 30 | board |
| 32 | board top |
| 34 | board edge |
| 36 | tape measure |
| 38 | tape |
| 40 | stop |
| 42 | index finger |
| 44 | middle finger |
| 46 | thumb |
| 48 | scale mark |
| 50 | knife |
| 52 | circular saw |
| 54 | saw foot |
| 56 | relief bevel |

DETAILED DESCRIPTION OF THE INVENTION

Figure 1:
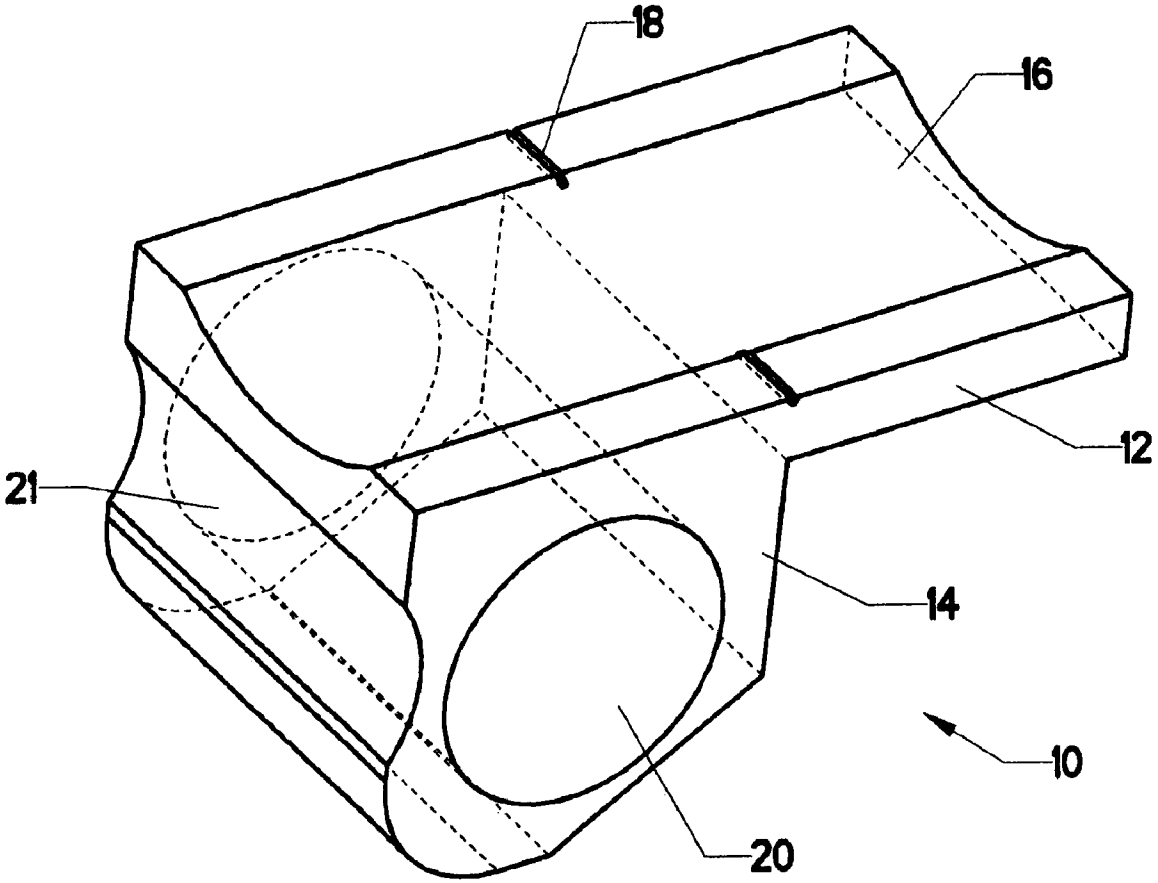
FIG. 1 is a perspective view, showing the present invention.
Figure 2:
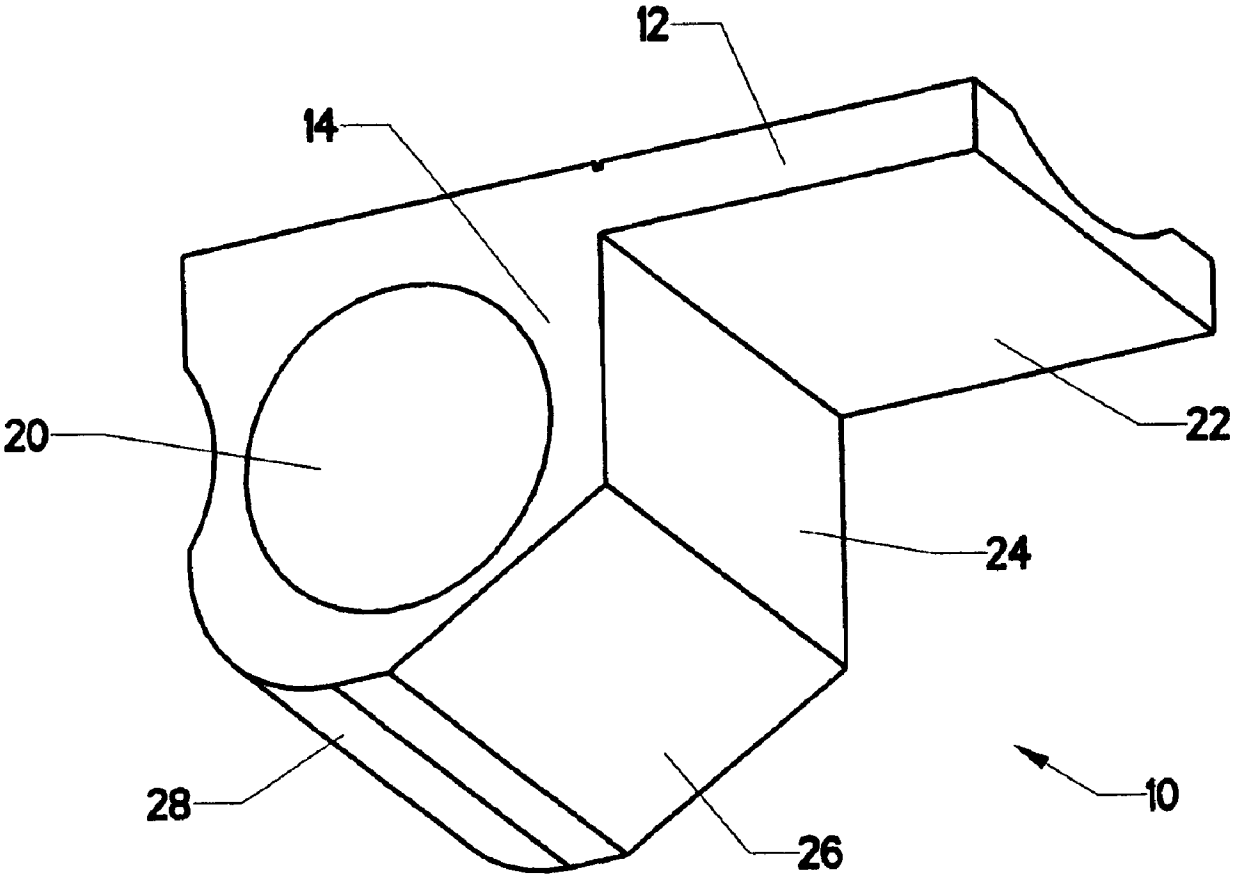
FIG. 2 is a perspective view, showing the present invention from another angle.

FIG. 1 shows finger guide 10. It is composed of two primary components—top guide 12 and edge guide 14. FIG. 2 shows the same device from a different vantage point. The lower surface of top guide 12 is designated as top mating surface 22. The adjacent edge of edge guide 14 is designed as edge mating surface 24. Top mating surface 22 and edge mating surface 24 are generally perpendicular.

In FIG. 1, the reader will observe that the upper surface of top guide 12 opens into tape trough 16. Two reference marks 18 are scribed into this upper surface as well. These marks are precisely aligned with edge mating surface 24.

Edge guide 14 opens into index finger hole 20, which passes transversely therethrough. Edge guide 14 also contains a second surface distal to edge mating surface 24. This second surface includes middle finger trough 21, the purpose of which will be explained subsequently. Edge guide 14 also contains relief bevel 26 and fillet 28. These features allow finger guide 10 to pass by obstructions in use.

Figure 3:
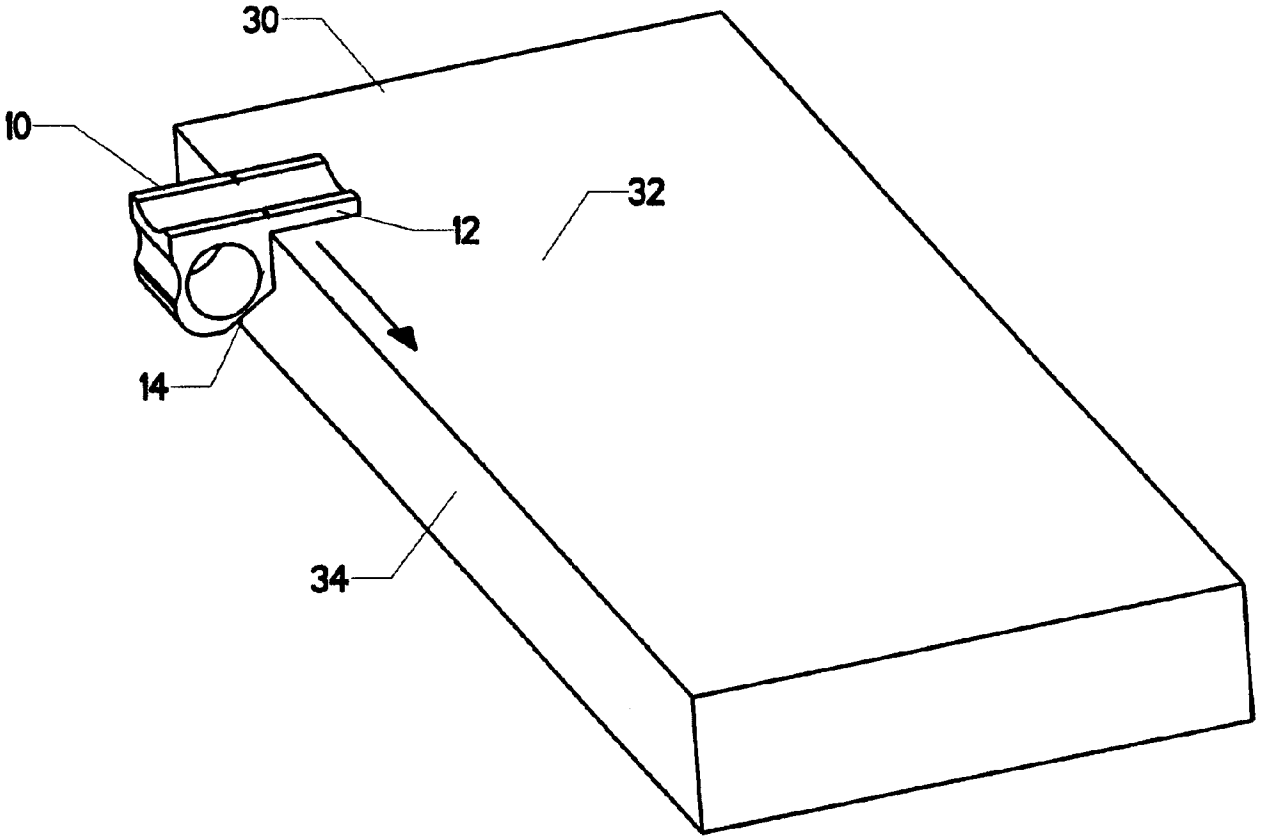
FIG. 3 is a perspective view, showing the invention in use.

FIG. 3 illustrates the typical manner of using the invention. Finger guide 10 has been applied to board 30 by placing top guide 12 on board top 32 and edge guide 14 on board edge 34. Top mating surface 22 rests firmly against board top 32; edge mating surface 24 rests firmly against board edge 34. The user can then slide finger guide 10 back and forth along board edge 34 (as indicated by the reciprocating arrow), while maintaining its orientation.

Figure 4:
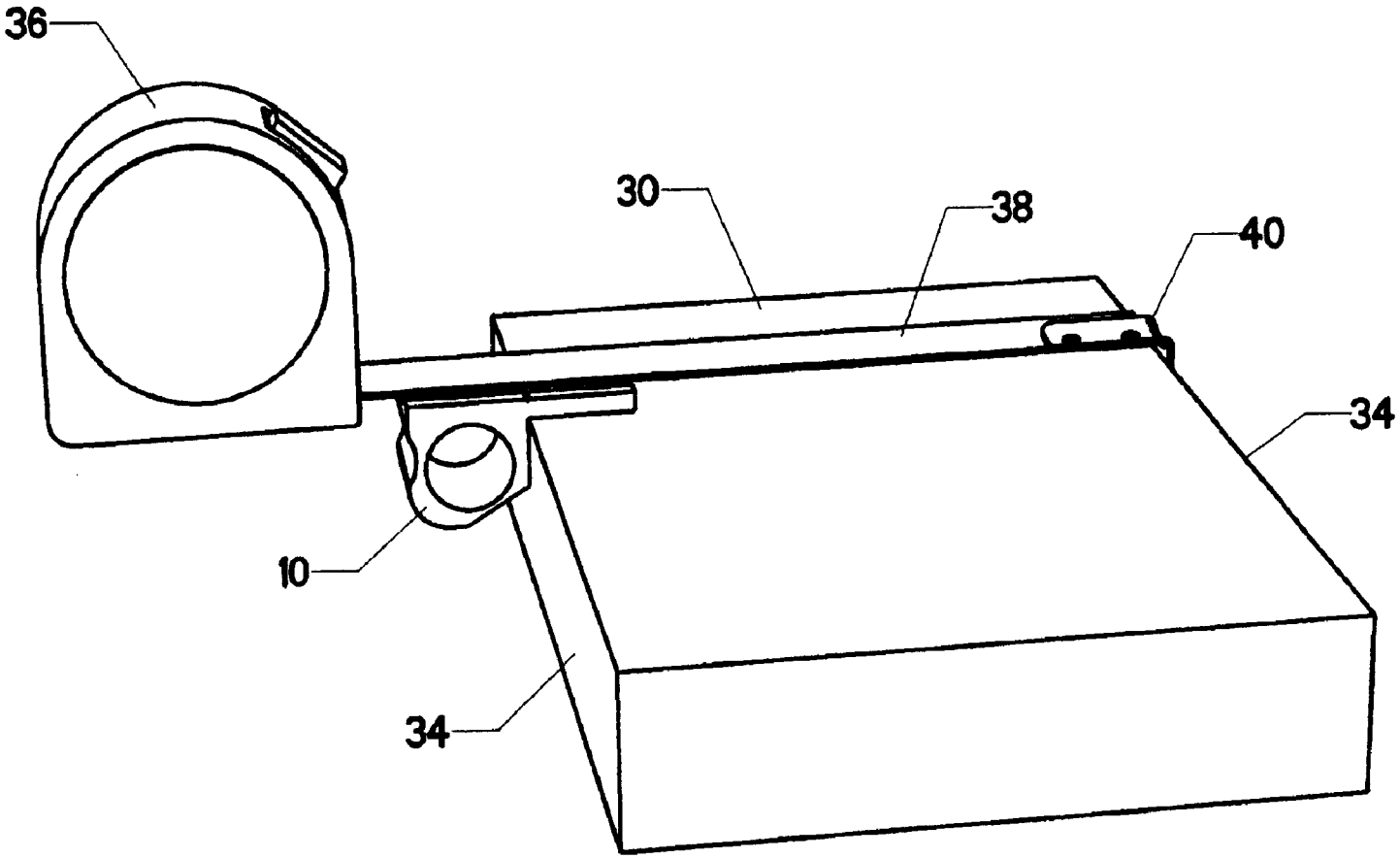
FIG. 4 is a perspective view, showing the invention being used with a tape measure.

A first use of finger guide 10 is the measurement of board widths. FIG. 4 shows finger guide 10 in position along board edge 34. A tape measure 36 is applied by dropping stop 40 over board 30's far edge and stretching tape 38 across the board as shown. Tape 38 will rest in tape trough 16.

Figure 5:
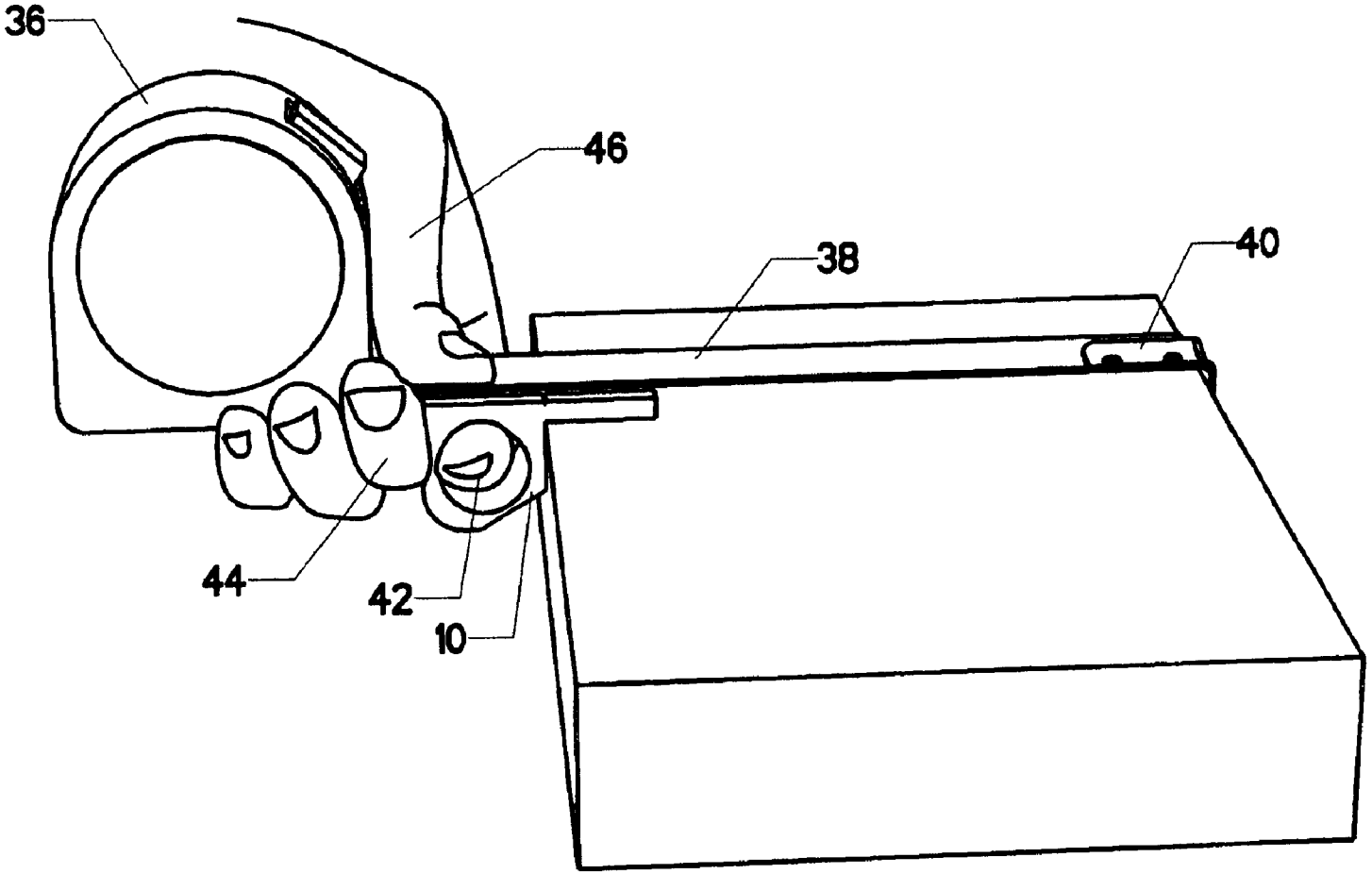
FIG. 5 is a perspective view, showing the invention being used with a tape measure.

FIG. 5 shows this assembly as it is actually held by the user. The user's index finger 42 passes through index finger hole 20. A portion of the user's middle finger 44 rests within middle finger trough 21. Tape measure 36 rests in the palm of the user's hand.

Figure 5B:
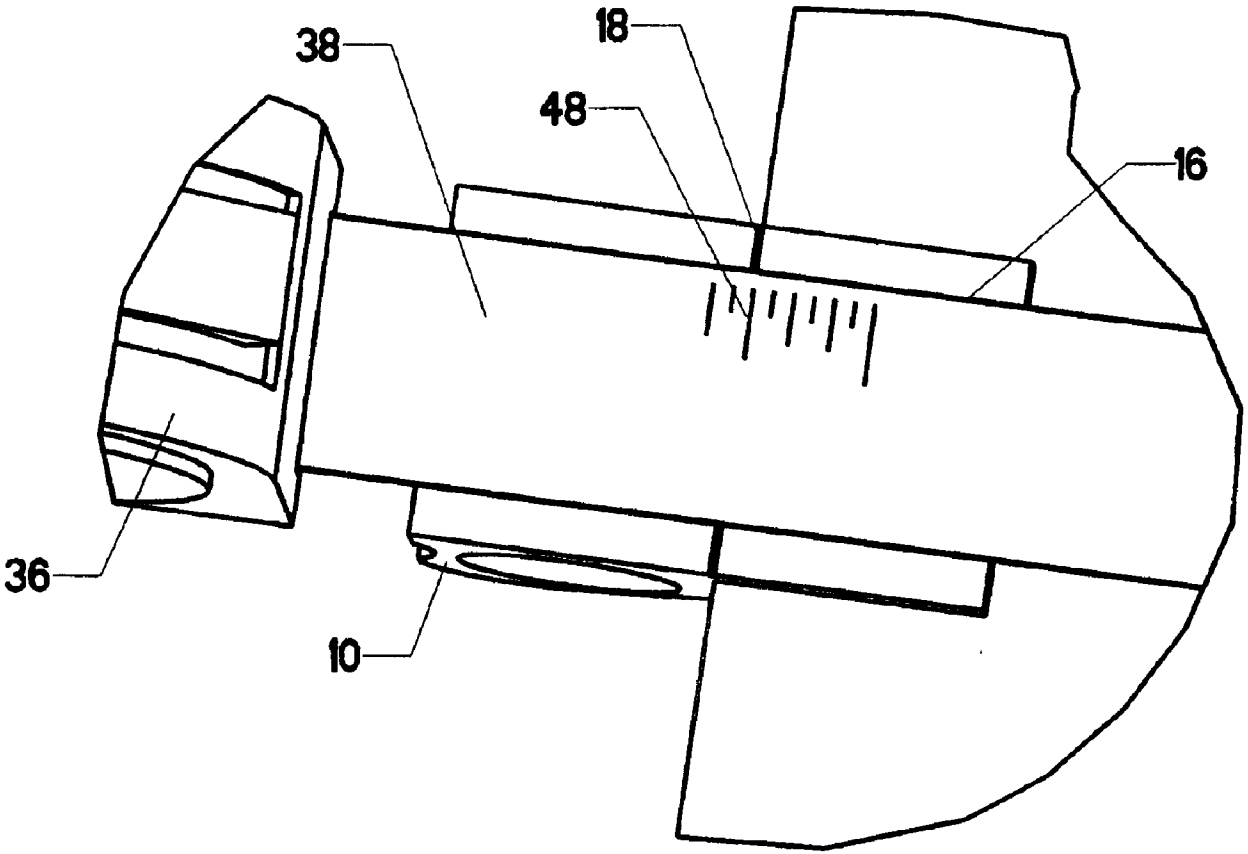
FIG. 5B is a perspective detail view, showing the invention being used to accurately measure a distance.

Finger guide 10 is thus worn like a ring, with the interface between the middle finger and middle finger trough 21 providing a stable orientation for finger guide 10 without the user having to tightly grip it. The user's thumb 46 is used to press tape 38 firmly down into tape trough 16. FIG. 5B is a closer top view of tape 38 lying within trough 16. The reader will recall that reference marks 18 are precisely aligned with edge mating surface 24, and therefore with board edge 34 itself. The user then reads the appropriate scale mark 48 on tape 38 in order to precisely determine the maximum width of the board. Those skilled in the art will know that measuring this width without the use of the finger guide can be inaccurate, since such a measurement typically is made at the top edge, which may or may not correspond to the maximum width.

Figure 6:
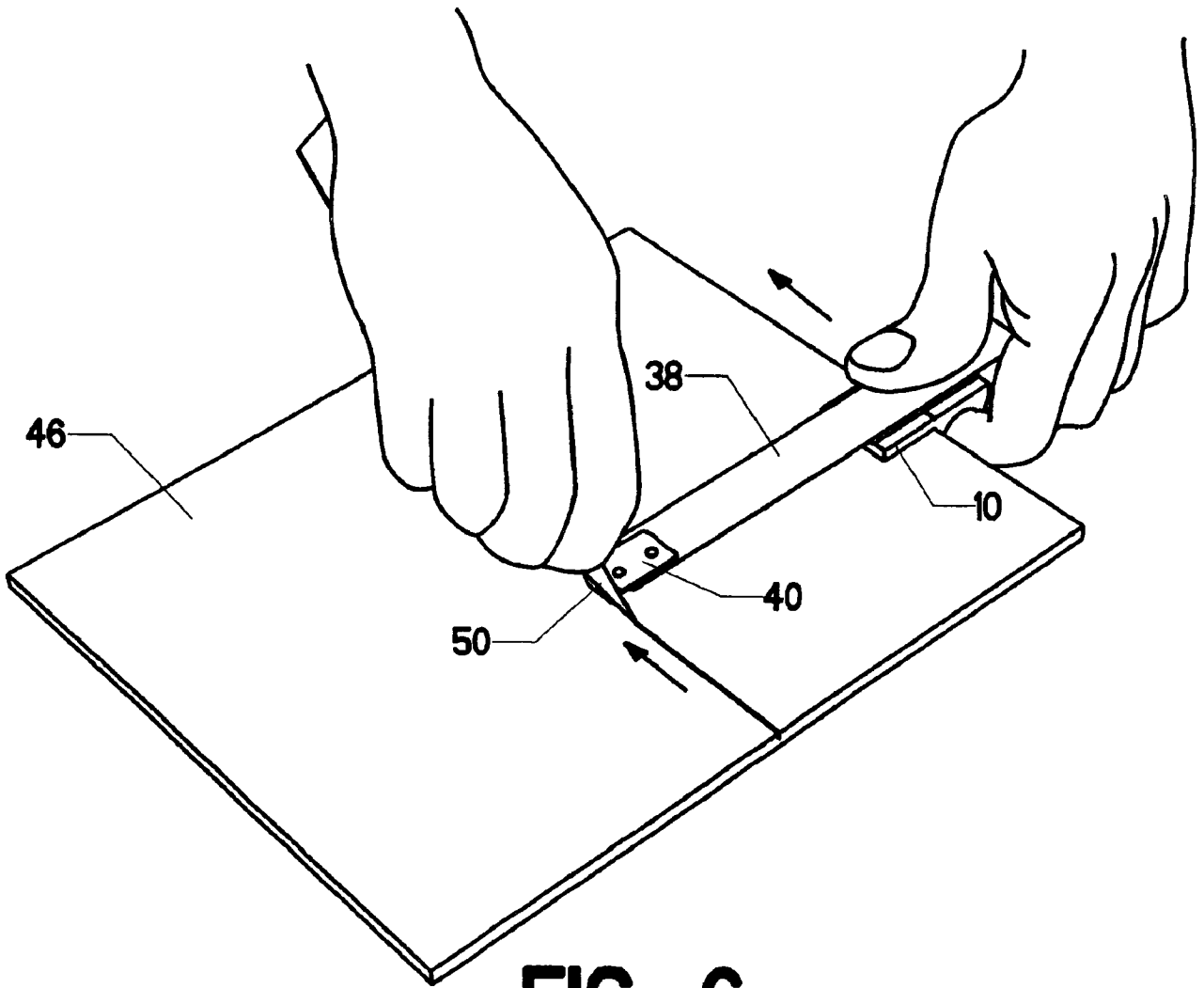
FIG. 6 is a perspective view, showing the invention being used to scribe a cut.

FIG. 6 shows another use of finger guide 10. The user can slide the device along the edge of a board or panel—in this case sheet rock 46. Ordinarily, this action would subject the user to splinters and abrasion. Because the user's index finger is protected completely by edge guide 14, however, these concerns are eliminated. In this particular example, the user wants to scribe a cut using knife 50. He or she pulls tape 38 out of tape measure 36 until the desired scale mark 48 is aligned with reference marks 18. If, as an example, the user wants to scribe a cut 5 inches off the reference edge, the 5 inch mark on the tape is aligned with reference marks 18. Knife 50 is then held against stop 40 and the assembly is moved in unison while the knife scribes a cut. The same technique can be used to mark a line. The user simply substitutes a marking pencil or pen for knife 50.

Figure 7:
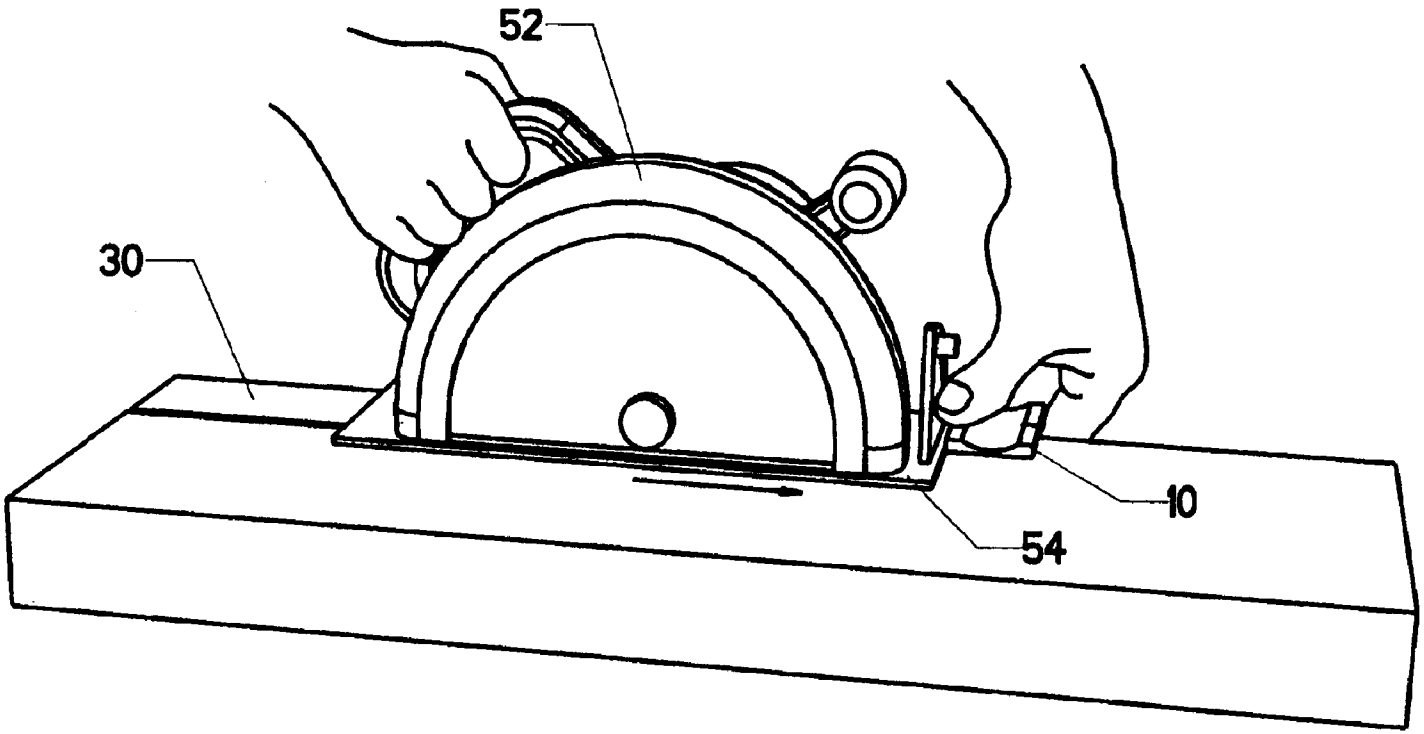
FIG. 7 is a perspective view, showing the invention being used as a saw guide.

FIG. 7 shows still another use of finger guide 10. Those skilled in the art will know that a carpenter's fingers are sometimes used to guide a circular saw in a long "rip" cut. Circular saw 52 has a square saw foot 54 as its base. In the prior art, a right-handed carpenter will grab saw foot 54 and allow his or her index finger to drop below the plane of the foot to act as an edge guide. The user then pushes the saw along, with the index finger maintaining the proper distance from the board's edge to the blade. Of course, this method is somewhat inexact. It also guarantees the addition of several splinters to the carpenter's hand over the course of a day.

Figure 8:
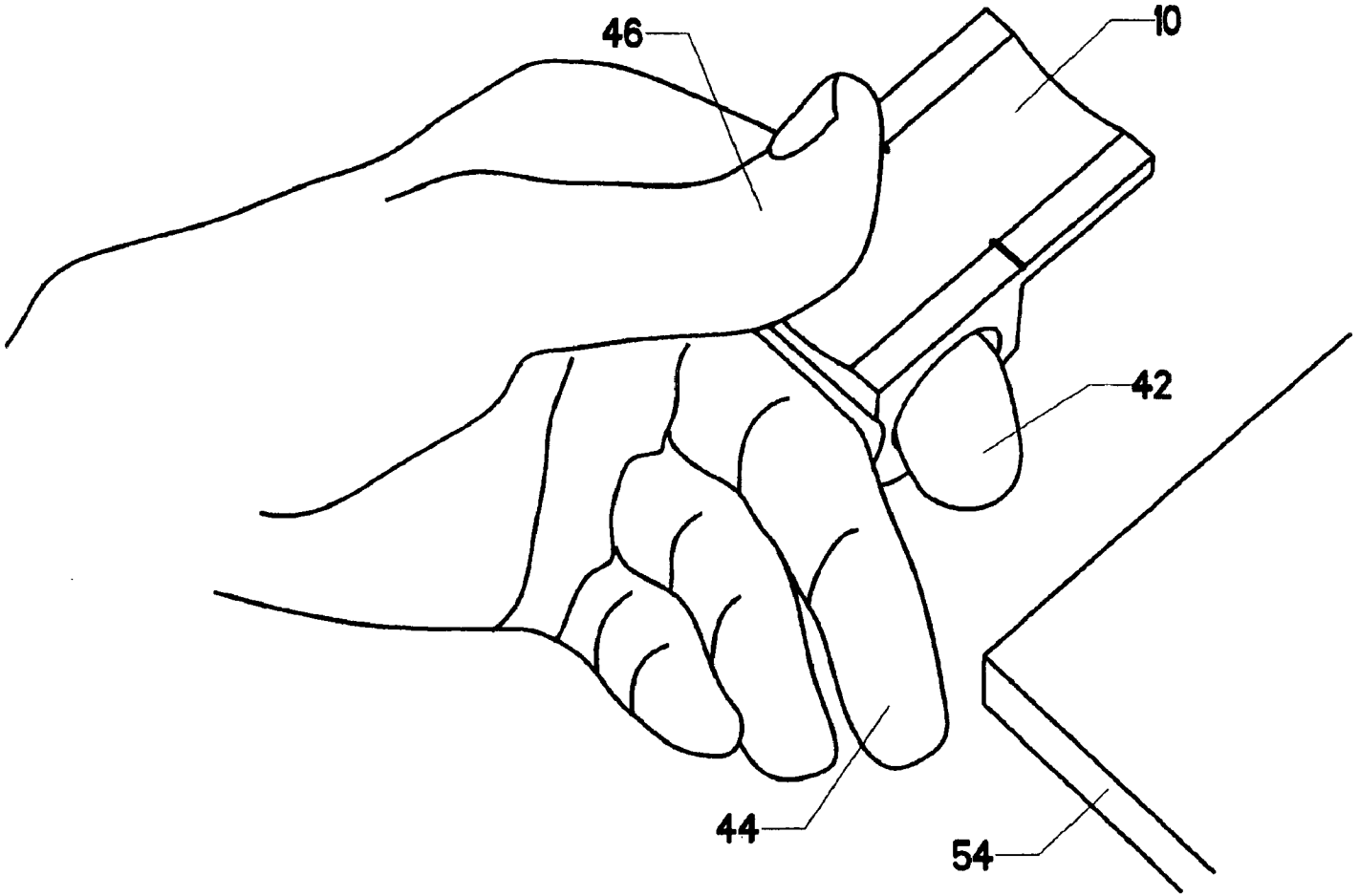
FIG. 8 is a perspective view, showing the use of the invention as a saw guide.

In FIG. 7, finger guide 10 has been placed just in front of saw foot 52, with edge mating surface 24 being pressed against the reference edge of board 30. The user then grabs finger guide 10 in the manner described previously and uses his or her fingers to clamp finger guide 10 against saw foot 54 so that finger guide 10 and circular saw 52 move in unison. FIG. 8 provides a visual explanation: The user slips index finger 42 through index finger hole 20 and places middle finger 44 against middle finger trough 21. The tips of the user's fingers extend well beyond finger guide 10. This fact allows the user to clamp saw foot 54 between the finger tips and thumb 46, thereby holding finger guide 10 securely against saw foot 54. The user then slides the two along, with the finger guide maintaining the proper position for the saw so that a straight cut results.

Figure 9:
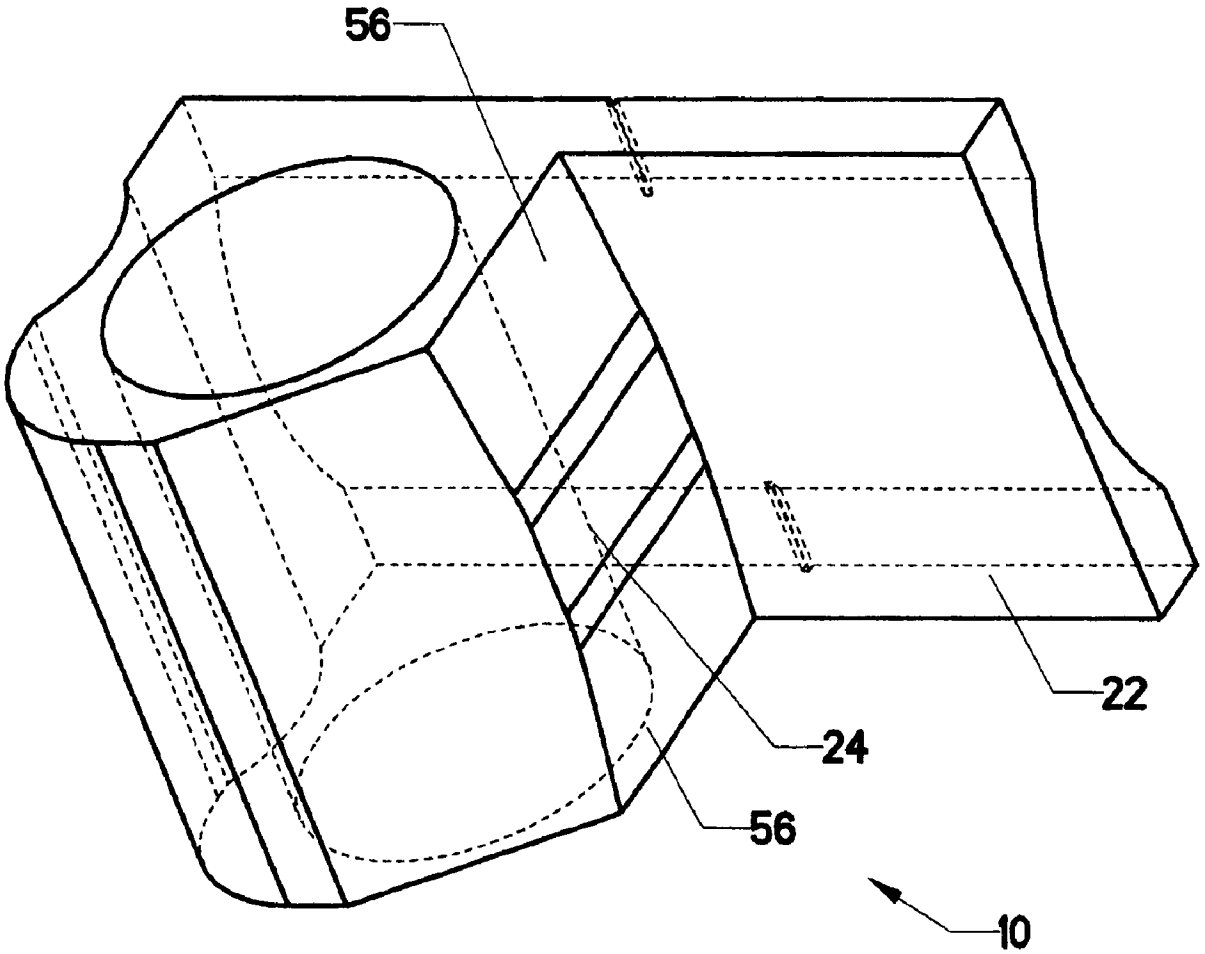
FIG. 9 is a perspective view, showing an alternate version of the edge mating surface

Returning now to FIG. 2, the reader will observe that edge mating surface 24 is planar. This need not be the case. In fact, a large and planar surface sometimes tends to snag as the finger guide is moved along. FIG. 9 shows a variant intended to remedy this concern. In FIG. 9, the size of edge mating surface 24 has been significantly reduced by the addition of two relief bevels 56. These features allow more of a "point" loading along the reference guide, which tends to reduce snagging. In the view as shown, edge mating surface 24 is a relatively small and flat plane. It can also be curved. For that case, the two reference marks 18 are aligned with the point of tangency for the curved edge mating surface.

The preceding descriptions contain significant detail regarding the novel aspects of the present invention. They should not be construed, however, as limiting the scope of the invention but rather as providing illustrations of the preferred embodiments of the invention. Thus, the scope of the invention should be fixed by the following claims, rather than by the examples given.

What is claimed is:

1. A finger guide allowing a user to perform measuring, marking, and cutting operation upon an object having a top surface and an edge, comprising:

a. a top guide, having an upper surface and a lower surface, wherein said lower surface is positioned to bear against said top surface of said object;

b. an edge guide, connected to said top guide and positioned to bear against said edge of said object;

c. an index finger hole passing completely through said edge guide, wherein said index finger hole is large enough to allow passage of said user's index finger therethrough;

d. said edge guide has an edge mating surface and a second surface distal to said edge mating surface; and e. said second surface includes a middle finger trough positioned to accommodate said user's middle finger.

2. A finger guide as recited in claim 1, wherein said upper surface of said top guide includes a reference mark.

3. A finger guide as recited in claim 1, wherein said edge mating surface of said edge guide includes a relief bevel.

4. A finger guide as recited in claim 1, wherein said upper surface of said top guide opens into a tape trough.

* * * * *